US005913983A

United States Patent [19]

Farmer

[11] Patent Number: 5,913,983

[45] **Date of Patent: *Jun. 22, 1999**

[54] EDGE VACUUM SYSTEM FOR REMOVING SLITTER SKIVINGS FROM A RUNNING WEB

[75] Inventor: Thomas M. Farmer, Hilton, N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/710,911

[22] Filed: Sep. 24, 1996

[51] Int. Cl.[6] ..... B08B 5/04

[52] U.S. Cl. ..... 134/9; 134/15; 134/16; 134/21; 83/100; 83/102; 83/302

[58] Field of Search ..... 134/9, 15, 21, 134/16, 32; 83/100, 102, 302

[56] References Cited

U.S. PATENT DOCUMENTS

| | | | |
|---|---|---|---|
| 2,722,983 | 11/1955 | Gibson et al. | 164/39 |
| 3,272,651 | 9/1966 | Quirk | 134/21 |
| 3,465,625 | 9/1969 | Daly | 83/100 |
| 3,691,888 | 9/1972 | Brandon | 83/302 |
| 3,795,164 | 3/1974 | Schneider | 83/349 |
| 4,003,276 | 1/1977 | Schmitt | 83/100 |
| 4,296,767 | 10/1981 | Hammar | 134/21 X |
| 4,300,421 | 11/1981 | Yano et al. | 83/99 |
| 4,333,369 | 6/1982 | McCort | 134/21 X |
| 4,491,485 | 1/1985 | Sanderson | 134/21 X |
| 4,704,930 | 11/1987 | Bodewein | 83/24 |
| 4,875,398 | 10/1989 | Taylor et al. | 83/100 |
| 5,400,543 | 3/1995 | Ideker, Jr. | 134/21 X |
| 5,480,333 | 1/1996 | Larson | 446/7 |

*Primary Examiner*—Jill Warden
*Assistant Examiner*—Alexander Markoff
*Attorney, Agent, or Firm*—Arthur H. Rosenstein

[57] ABSTRACT

A method and apparatus for removing skivings generated by slicing a moving web comprises a slitter knife for cutting the web and an edge vacuum machine comprising at least two vacuum heads which engulf but do not touch the moving web. Skivings from the edges of the web are vacuumed away so that they do not contaminate the web during later treatment.

10 Claims, 1 Drawing Sheet

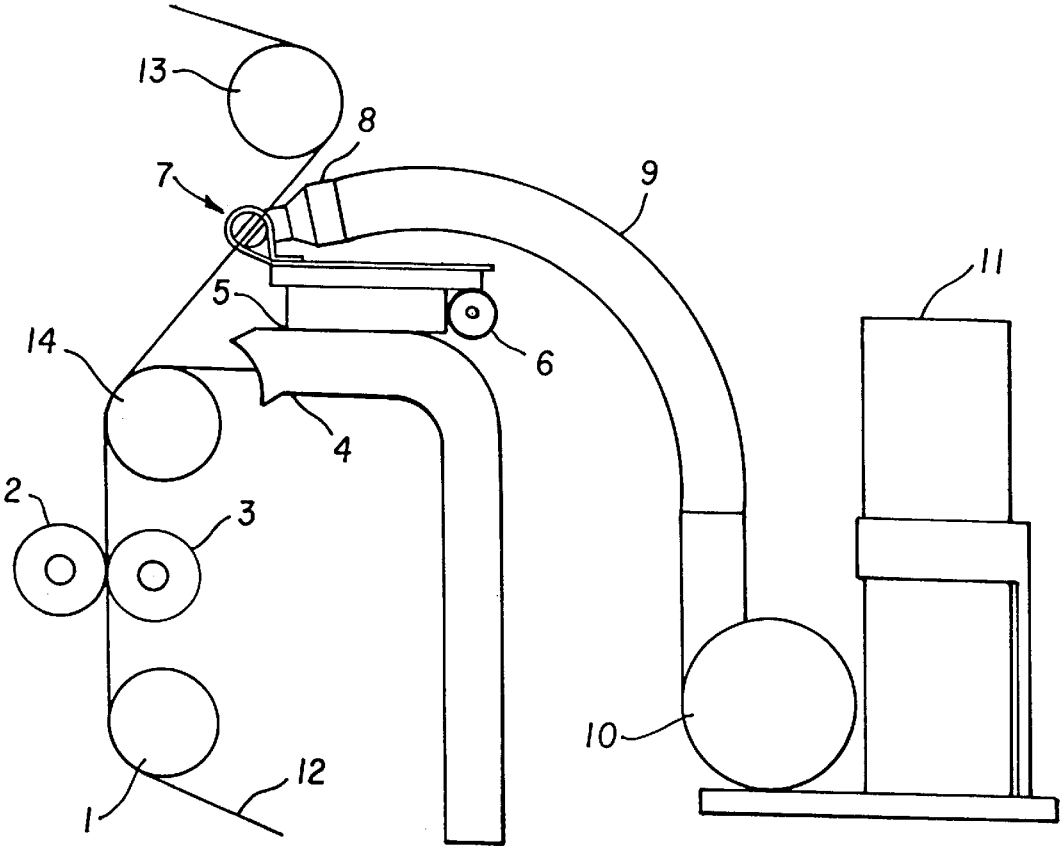
FIG. 1
FIG. 2
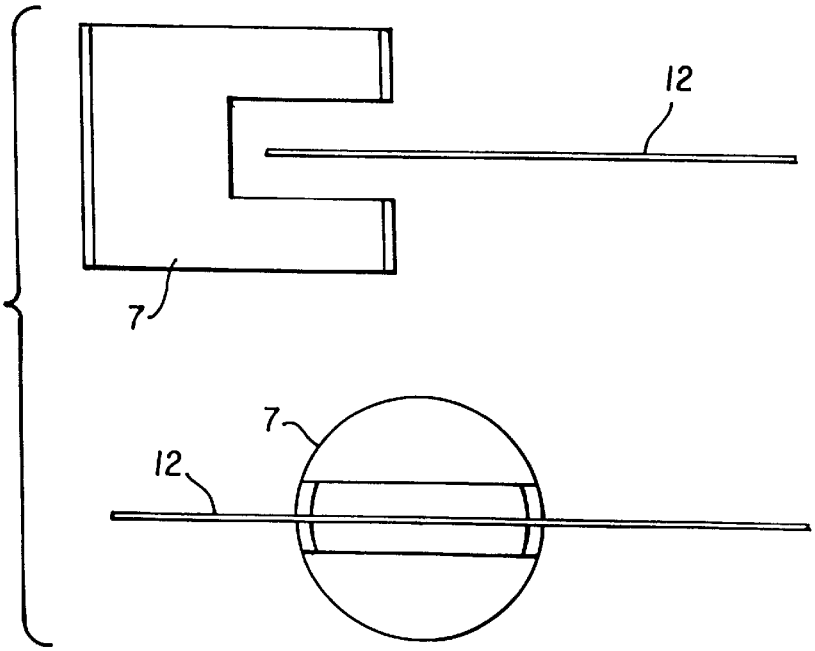

EDGE VACUUM SYSTEM FOR REMOVING SLITTER SKIVINGS FROM A RUNNING WEB

FIELD OF THE INVENTION

This relates to a method and apparatus for removing slitter skivings from a web that is moving through a conveyor system to be treated. The skivings are removed to avoid contamination to the web.

BACKGROUND OF THE INVENTION

In many systems of treating web material it is necessary to treat the web in a continuous fashion by conveying the web through various steps. A common step is to cut the web to a desired size. Thus a slitting step is included in many operations.

In these operations, such as the treatment of polyethylene coated paper webs for inducing photographic film or paper, the slitting operation produces skivings which when settling on the web, produces contaminants which adversely affect the final product.

Thus, in the photographic field, a high quality raw stock paper is sandwiched between two layers of high grade molten polyethylene in a continuous operation at a high rate of speed.

As the polyethylene is applied to the paper, it is squeezed between cooled rollers in a pressurized nip area. As a result, some of the polyethylene is forced past the edges of the paper, creating what is known in the trade as overcoat.

This overcoat is beneficial due to the fact that it can be used somewhat to control the caliper of the papers edges, as well as lock the paper into a sealed environment with a process called edge encapsulation.

It is this overcoat material that leads to the problem of the operation.

As desirable as the overcoat is, if left on in its entirety, it causes many problems downstream of the operation, for this reason as a step in the process, it is trimmed off in a final width slitting operation.

As the paper enters the winder area, it passes through a set of rotary slitter knives which are set to a pre determined width for the particular grade being run.

These knives turn at line speed and in fact, trim off the undesirable part of the overcoat. In doing so, a small amount of polyethylene is rubbed off of the trimmed edge, and left clinging to the rotary slitter knife. As the knives collect this material (known in the business as skivings) it is gradually thrown off by centrifugal force.

As the skivings become airborne, they are picked up by the static charge created by the moving web of polyethylene coated paper and carried onto the finished product where they are crushed into the surface by the nip pressure and the mass of the finished roll at the winding operation.

As a safeguard against sparking in the sensitizing operation the paper is generally treated with an antistatic coating on one side.

As the rolls sit in storage, they lose any static charge that was built up in the winding operation and as a result, when the rolls are unwound in the next operation, some of the skivings again become airborne, and now contaminate even more of the web instead of just the edges.

Even worse, as the paper conveys through the sensitizing machine, some of the embedded particles come free and contaminate the rest of the web.

An across the web system has existed for many years, and various other systems exist to clean moving webs, but however, poly skivings are a unique problem, because they have always existed but were never diagnosed before as a contaminant. With the increasing demand on higher quality products, and the thinner more surface sensitive emulsions coming onto the market they have become a defect that has stirred up a great amount of concern in finishing. In the business of creating an absolutely flat surface, any disruption in that surface can be a major problem, especially in the photographic industry where a minute surface disruption can actually change a color, or show up as a colored spot on a finished photo. An absolutely clean base is a must.

Poly skivings are a hard defect to deal with because by nature, they are light in weight, small in size, prone to static cling and once they are in a clean environment, they are all but impossible to get rid of.

The prior art has dealt with the slitter skiving problem in many ways. In U.S. Pat. No. 2,722,983, a device is shown for cutting wire and string products. In U.S. Pat. No. 4,875,398, a device is shown which collects saw dust for slitting sheets. The removal of slitting dust is described in U.S. Pat. Nos. 3,272,651; 4,704,930; 4,300,421; 3,795,164; 3,465,625; 3,691,888; 4,003,276; and 5,480,333. Although various methods are taught to remove contaminants, the problem still remains, especially in high speed operations.

SUMMARY OF THE INVENTION

It is an object of this invention to remove slitter skivings produced by slitting a continuously moving web at their source, before they can spread or be made more permanent by being compressed into a roll of the web.

It is a further object of this invention to eliminate the contamination of an entire web which results for cleaning only a small amount of the total width prior to the next treatment.

It is a still further object of the present invention to employ an operation for forming photographic webs including slitting of the webs and insuring that the skivings never make it into the sensitizing environment.

By using the edge vacuum system of this invention, the skivings are completely eliminated within a few feet of their source, thus insuring that they can not become airborne, and be wound into the finished roll to cause all of the problems described above.

The edge vacuum system consists of a dust collection system equipped with filter bags to allow for collection and analysis of the skivings being pulled off of the paper. The collector is coupled to hard piping under the machines frame. At the end of the hard pipes are flexible lines used to allow for different width positioning that connect to the vacuum heads.

The vacuum heads themselves are similar in shape to a clam shell and they are capable of engulfing, without actually touching the edges of the running web allowing for a stronger and more focused vacuum path as the paper runs through them at high line speeds of up to 1000 feet per minute.

The system is guarded by ½" screening so that in the event of a tear off of the line, nothing larger would be able to enter and plug up the hard piping.

The vacuum heads are mechanically fastened by way of adjustable brackets to pneumatically retractable slides that allow for the room necessary to thread up the line, or work in the crowded winder area for winding the web.

This apparatus for removing slitter skivings from a web running through a conveyor to carry a web of material through a treatment process including slicing comprises;

a slitter knife for cutting said web material as it is conveyed; and an edge vacuum mechanism comprising at least two vacuum heads which are capable of engulfing but do not touch the edges of the moving web material wherein the web moves between said heads and slitting debris is removed by said vacuum heads.

BREIF DESCRIPTION OF THE DRAWINGS

FIG. 1 is a schematic view of the cutting and slitter removal for a continuously moving web.

FIG. 2 is a side and front view of web passing through the vacuum apparatus of the present invention.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE PREFERRED EMBODIMENTS

FIG. 1 shows the operation of photographic web material which includes slitting and winding into a roll, including the edge vacuum apparatus of this invention.

In FIG. 1, the paper web 12 is guided through the vacuum heads 7 idle rollers 1 and 14 and through slitter knife 3, supported by roll 2 and finally to roll 13.

The critical edge vacuum apparatus comprises vacuum heads 7 trimming removal chute 4, an edge vacuum slide mechanism 6, a reducer 8 to increase edge vacuum velocity, a flexible vacuum hose 9 to allow for variable widths of web, a dedicated vacuum source 10 and filter bags 11 for collecting debris.

The vacuum heads, 7 as shown in FIG 1 can be made from 2½" long, 2" polyvinylchloride (PVC). One end is closed off with ⅛ sheet plastic glued permanently in place. A ¾" slot is then cut 1" deep across the center of the closed off end forming a clamshell shape. This size was chosen for a vacuum pump with 12000 CFM draw because it would pick up the skivings, but stay far enough away from the paper to have the least chance of touching the finished product. Other sizes will work for particular vacuum pump being used. This shape allows both sides of the paper to be vacuumed with equal strength.

FIG. 2 illustrates the side and front view of the web 12 moving through vacuum head 7. Each edge of the web goes through clamshell shaped vacuum head 7 so as to remove the skivings without touching web 12.

The vacuum heads can be set into 2" PVC elbows which have their openings guarded by discs of ½ wire screening. This limits the size of debris allowed into the system. The elbows are fitted into 2" by 3" reducers 8 put in place to increase the air currents velocity at the vacuum heads. These are fitted to 4" wire reinforced flexible hosing 9 which is used in the system to allow for the flexibility needed in the variable widths of product run on the poly machines. The rest of the system consists of 3" PVC pipe and fittings, such as elbows, pipe, and a Tee fitting to allow for a center vacuum pickup when the paper is being center slit, needed to fit the physical constraints of the winder area. The vacuuming takes place, preferably as close to the slitters as possible (e.g. 2–4 ft.)

The whole system dumps into a 2HP dust collector 10 with cloth filter bags 11 for data collection. The vacuum heads are fitted to custom pneumatic retracting devices 5 and are attached to the poly machines trim chutes 4 but would work equally well mounted anywhere else.

The retracts 5 consist of custom built dovetail sliders fitted with small air cylinders 6 capable of allowing 3" of travel for the vacuum heads on each side of the web. These are installed to allow ease of thread up in the cramped winder/slitter area 2, 3.

The system runs on 230 volt single phase wiring, and is rated for continuous duty. It can however be turned on and off by using a switch provided with the unit (not shown).

This system being simple in nature is a very efficient and low-cost way of dealing with debris generated when using slitter knives. It can be fitted to almost any machine, and has the advantage of being moved out of the way when needed. It can be set up to handle any amount of slitters, and it removes the contamination at its source.

While the invention has been described with particular reference to a preferred embodiment, it will be understood by those skilled in the art the various changes can be made and equivalents may be substituted for elements of the preferred embodiment without departing from the scope of the invention. In addition, many modifications may be made to adapt a particular situation in material to a teaching of the invention without departing from the essential teachings of the present invention.

I claim:

1. Edge vacuum apparatus for removing polyskivings from a web running through a conveyor, said apparatus comprising:

a conveyor to convey a web of material through a treatment process including slicing;

a slitter knife for cutting said web as it conveyed; and an edge vacuum mechanism comprising a vacuum source and at least two vacuum heads connected to said vacuum source, each of said vacuum heads engulfing but not touching only one of the outside edges of the conveyed web wherein said vacuum heads are positioned so that the web is conveyed between said vacuum heads and the vacuum pulls the polyskivings across the edges of the conveyed web, toward the vacuum heads removing said polyskivings.

2. The apparatus of claim 1 wherein the vacuum heads are shaped in the form of a clamshell.

3. The apparatus of claim 1 wherein the vacuum heads are positioned in the vicinity of the slitter knife.

4. The apparatus of claim 1 wherein the vacuum source is a vacuum pump.

5. The apparatus of claim 1 wherein the vacuum heads are fitted to flexible hosing which can be positioned according to the width of the web.

6. The apparatus of claim 1 wherein the edge vacuum mechanism contains a collector for collecting skivings.

7. A method of slitting web material on a continuously moving conveyor, said method comprising:

slicing said web material as it being conveyed;

removing polyskivings from the moving web material by vacuuming the polyskivings with at least two vacuum heads, each of said vacuum heads engulfing but not touching only one of the outside edges of the conveyed web material, and positioning said vacuum heads so that the web material is conveyed between said vacuum heads and the vacuum pulls the polyskivings across the outside edges toward the vacuum heads removing said polyskivings.

8. The method of claim 7 including positioning the vacuum heads according to different web widths.

9. The method of claim 7 wherein the vacuuming takes place within 2–4 feet from the slicing of the web material.

10. The method of claim 7 wherein the polyskivings are collected in a container during the vacuuming.

* * * * *